US007297090B2

(12) United States Patent
Torres

(10) Patent No.: US 7,297,090 B2
(45) Date of Patent: Nov. 20, 2007

(54) PERSONAL EXERCISE DEVICE

(76) Inventor: Serafino Torres, 1225 Windsor Rd., Cardiff-by-the-Sea, CA (US) 92007-1344

( * ) Notice: Subject to any disclaimer, the term of this patent is extended or adjusted under 35 U.S.C. 154(b) by 234 days.

(21) Appl. No.: 11/230,751

(22) Filed: Sep. 20, 2005

(65) Prior Publication Data

US 2007/0066460 A1 Mar. 22, 2007

(51) Int. Cl.
*A63B 71/00* (2006.01)
*A63B 21/02* (2006.01)
*A63B 21/045* (2006.01)

(52) U.S. Cl. ..... 482/74; 482/51; 482/124; 482/127

(58) Field of Classification Search ..... 482/51, 482/74, 124, 127, 128, 905; 602/16, 26; 601/35; 434/247, 255
See application file for complete search history.

(56) References Cited

U.S. PATENT DOCUMENTS

| | | | | |
|---|---|---|---|---|
| 406,328 | A * | 7/1889 | Yagn | 482/77 |
| 420,178 | A | 1/1890 | Yagn | |
| 2,097,376 | A | 10/1937 | Marshman | |
| 2,613,932 | A | 10/1952 | Manners | |
| 3,162,441 | A | 12/1964 | Karlik | |
| 4,872,665 | A | 10/1989 | Chareire | |
| 4,955,608 | A | 9/1990 | Dougherty | |
| 4,961,573 | A | 10/1990 | Wehrel | |
| 5,176,377 | A | 1/1993 | Wilkinson | |
| 5,197,931 | A * | 3/1993 | Wroclawsky | 482/74 |
| 5,330,417 | A * | 7/1994 | Petersen et al. | 602/16 |
| 5,372,565 | A | 12/1994 | Burdenko | |
| 5,618,249 | A * | 4/1997 | Marshall | 482/127 |
| 5,813,955 | A | 9/1998 | Guthowsk | |
| 6,030,321 | A * | 2/2000 | Fuentes | 482/83 |
| 6,132,346 | A * | 10/2000 | Weeks | 482/124 |
| 6,280,365 | B1 * | 8/2001 | Weber et al. | 482/124 |
| 7,153,242 | B2 * | 12/2006 | Goffer | 482/66 |
| 2004/0053755 | A1 * | 3/2004 | Wilkinson | 482/124 |

* cited by examiner

*Primary Examiner*—Stephen R. Crow
*Assistant Examiner*—Allana Lewin
(74) *Attorney, Agent, or Firm*—John R. Ross; John R. Ross, III

(57) ABSTRACT

A personal exercise device having a body mounted shaft housing for mounting a shaft at a position near the rear portion of a user's waist. A shaft is confined within the shaft housing. Two leg mounts are attached to each of two legs of the user near the user's knees. Each of two torque arms are attached pivotally at one end to one of the leg mounts and also attached pivotally at the other end to the shaft. A torque adjustment device is also included and is for adjusting the torque required to produce pivot motion of the torque arms about the shaft. Also, a preferred embodiment includes two handles are connected to the body mounted housing unit via two flexible cords. The user preferably gains cardiovascular training utilizing the device while walking or running and gains additional resistance training by appropriately adjusting the torque and pulling the handles.

19 Claims, 6 Drawing Sheets

PERSONAL EXERCISE DEVICE

The present invention relates to exercise devices, and in particular, to personal exercise devices.

BACKGROUND OF THE INVENTION

World records in endurance sports are not accomplished at age 55. This is because one of the unavoidable consequences of aging is a decline in the maximal capacity of the cardiovascular system to pump blood and deliver oxygen while removing metabolic waste products. The components of the cardiovascular pump performance are 1) the maximal heart rate that can be achieved, 2) the size and contractility of the heart muscle, and 3) the compliance (stiffness) of the arterial tree. It is known that aging affects each of these three variables.

Young children generally have a maximal heart rate that approaches 220 beats per minute. This maximal rate falls throughout life. By age 60, maximal heart rate in a group of 100 men will average about 160 beats per minute. This fall in heart rate seems to be a linear process so that maximal heart rate can be estimated by the formula: Max heart rate=220−age. This is an estimate, however. If the maximal heart rates of those same 100 men are measured during a maximal heart rate test, there would probably be a range of heart rates between 140 and 180 beats per minute.

There is no strong evidence to suggest that training influences the decline in maximal heart rate. The blood pumped out of the heart enters the systemic arterial system. For the youth, this system of arteries is quite flexible or compliant. This is important for the performance of the heart. Compliant vessel walls stretch when blood is pumped through them, lowering the resistance that the heart must overcome to eject it volume of each beat. As we age, these vessels loose their elasticity. Consequently, resting blood pressure and blood pressure during exercise slowly increase as we age. Continued training appears to reduce this aging effect, but does not eliminate it. Increased peripheral resistance results in a decrease in maximal blood flow to working muscles. However, at sub maximal exercise intensities, the 10%-15% decrease in blood flow is compensated for by the increase in oxygen extraction. This compensation is probably possible due to the increased transit time of the blood through the capillary tree.

In the sedentary population, cardiovascular performance declines progressively. Much of this decline is due to 1) physical inactivity and 2) increased body weight (fat). Maximal oxygen consumption declines about 10% per decade after age 25. However, if body composition is maintained and physical activity levels are kept constant, the decline in maximum oxygen uptake (VO2 Max) due to aging is only about 5% per decade. Prior to age 50, this decline may even be less, perhaps on 1%-2% per decade in hard training master athletes. Ultimately, cardiovascular capacity is reduced, however, due to the unavoidable decline in maximal heart rate.

Currently in America approximately one in three or 58 million American Adults aged 20 through 74 are overweight. This is true even though more is now known than ever before about the harmful effects of being overweight and in poor physical condition. Every year as society is becoming more automated many manual labor jobs are being replaced by machines. There is less physical labor Americans must do. Also, for most people large amounts of food are easy to find and afford.

Some people are able to successfully start and stay with a healthy exercise program that involves weight lifting and cardiovascular exercise. Many of these people join gyms to have access to expensive machines designed to help them exercise. However, many people find it difficult and expensive to exercise at a gym. There are also additional problems with gyms at a fitness studio and/or home gyms. For example, conventional design fitness machines are generally in fixed locations in a fitness studio or at the user's residence. Fitness machines typically provide only one direction of motion for training. Also, with fitness machines each individual muscle group (agonist) is trained individually, that is, without stressing its opposing muscle group (antagonist) with reversed movement sequences. In the prior art there are a few stationary machines that train only a small number of muscle groups. Hence, in order to train a large number of muscle groups, prior art fitness machines require high mechanical and equipment expense for multiple machines.

With all the problems associated with prior art stationary gym equipment, some people decide to start walking or running for exercise. These exercises are good for cardiovascular exercise but they are not as effective as resistance training for muscular exercise and development.

What is needed is a personal exercise device that combines cardiovascular training and resistance training.

SUMMARY OF THE INVENTION

The present invention provides a personal exercise device having a body mounted shaft housing for mounting a shaft at a position near the rear portion of a user's waist. A shaft is confined within the shaft housing. Two leg mounts are attached to each of two legs of the user near the user's knees. Each of two torque arms are attached pivotally at one end to one of the leg mounts and also attached pivotally at the other end to the shaft. A torque adjustment device is also included and is for adjusting the torque required to produce pivot motion of the torque arms about the shaft. Also, a preferred embodiment includes two handles are connected to the body mounted shaft housing unit via two flexible cords. The user preferably gains cardiovascular training utilizing the device while walking or running and gains additional resistance training by appropriately adjusting the torque and pulling the handles.

DETAILED DESCRIPTION OF PREFERRED EMBODIMENTS

Figure 1D:
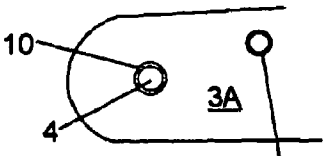
FIG. 1D shows a side view of a preferred shaft housing unit.
Figure 1B:
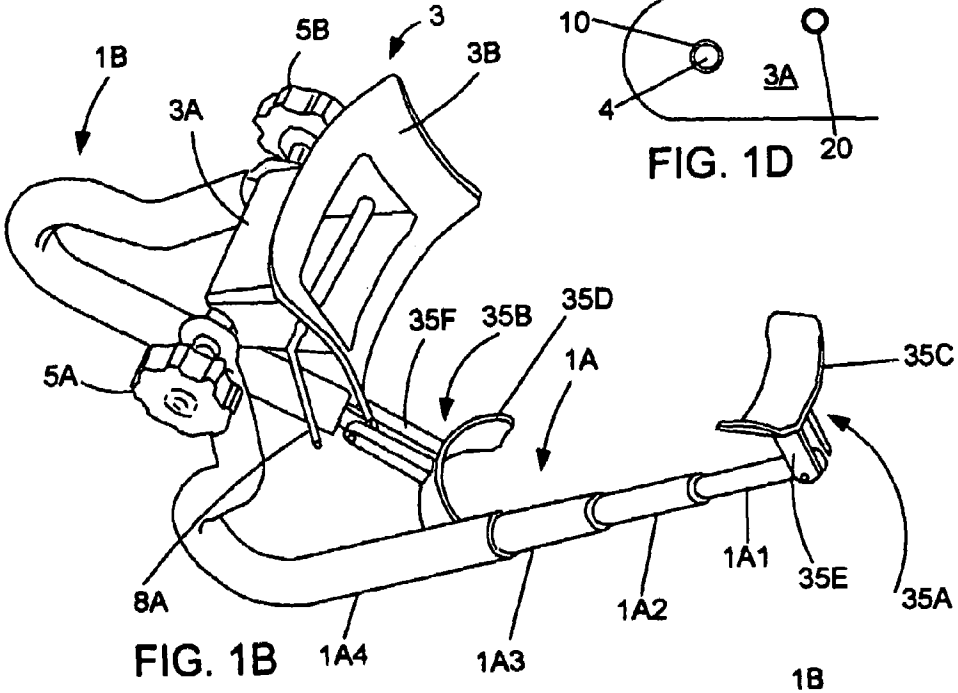
FIG. 1B shows a perspective view of a preferred shaft housing unit and torque arms.
Figure 1C:
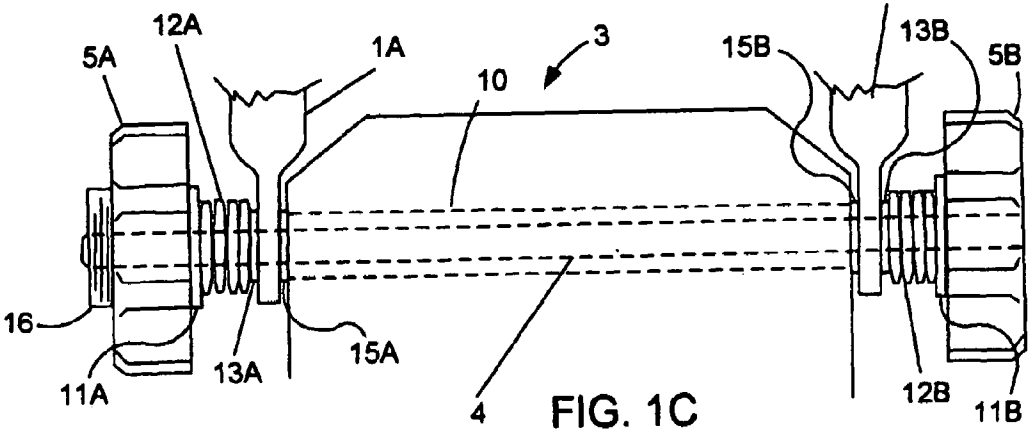
FIG. 1C shows a preferred shaft housing unit.
Figure 1A:
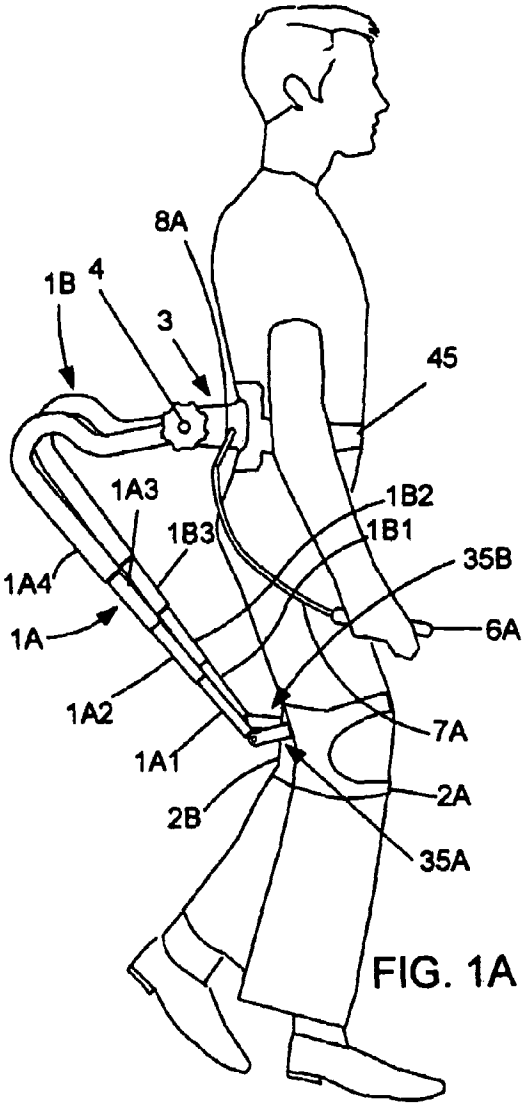
FIG. 1A shows a user utilizing a preferred embodiment of the present invention.

FIG. 1A shows a first preferred embodiment of the present invention. At one end, torque arms 1A and 1B are connected to leg mounts 35A and 35B, respectively. At their other ends, torque arms 1A and 1B are pivotally attached to shaft 4 that extends through shaft housing unit 3 (FIG. 1C). Forward and backward motion of the legs (such as a walking or running motion) causes torque arms 1A and 1B to automatically pivot about shaft 4. The user can turn knob 5A or knob 5B clockwise to increase the amount of torque required to pivot torque arms 1A and 1B around shaft 4. In other words, as knob 5A or knob 5B is tightened greater resistance is produced. Therefore, it becomes increasingly more difficult for the user to overcome the resistance and for the user to move his legs forward and backward in a walking or running motion. By overcoming this increased resistance the user exercises a variety of muscles and improves his physical condition. Also in a preferred embodiment, handles 6A and 6B are connected to handle rods 8A and 8B via rubber cords 7A and 7B (FIGS. 1A, 2A-2D, and 3A). By pulling handles 6A and 6B, a user can further exercise muscles in his arms and upper body.

Torque Arms

Torque arm 1A preferably has three telescopic sections 1A1, 1A2 and 1A3 (FIGS. 1A, 1B) that connect to main torque arm section 1A4. Likewise, torque arm 1B preferably has three telescopic sections 1B1, 1B2 and 1B3 that connect to main torque arm section 1B4. In a preferred embodiment, the perpendicular distance from shaft 4 to the line formed by the telescopic sections is approximately 12 inches.

Figures 4, 5, 10, 16A, 16B, 17, 18A, 18B, 18C:
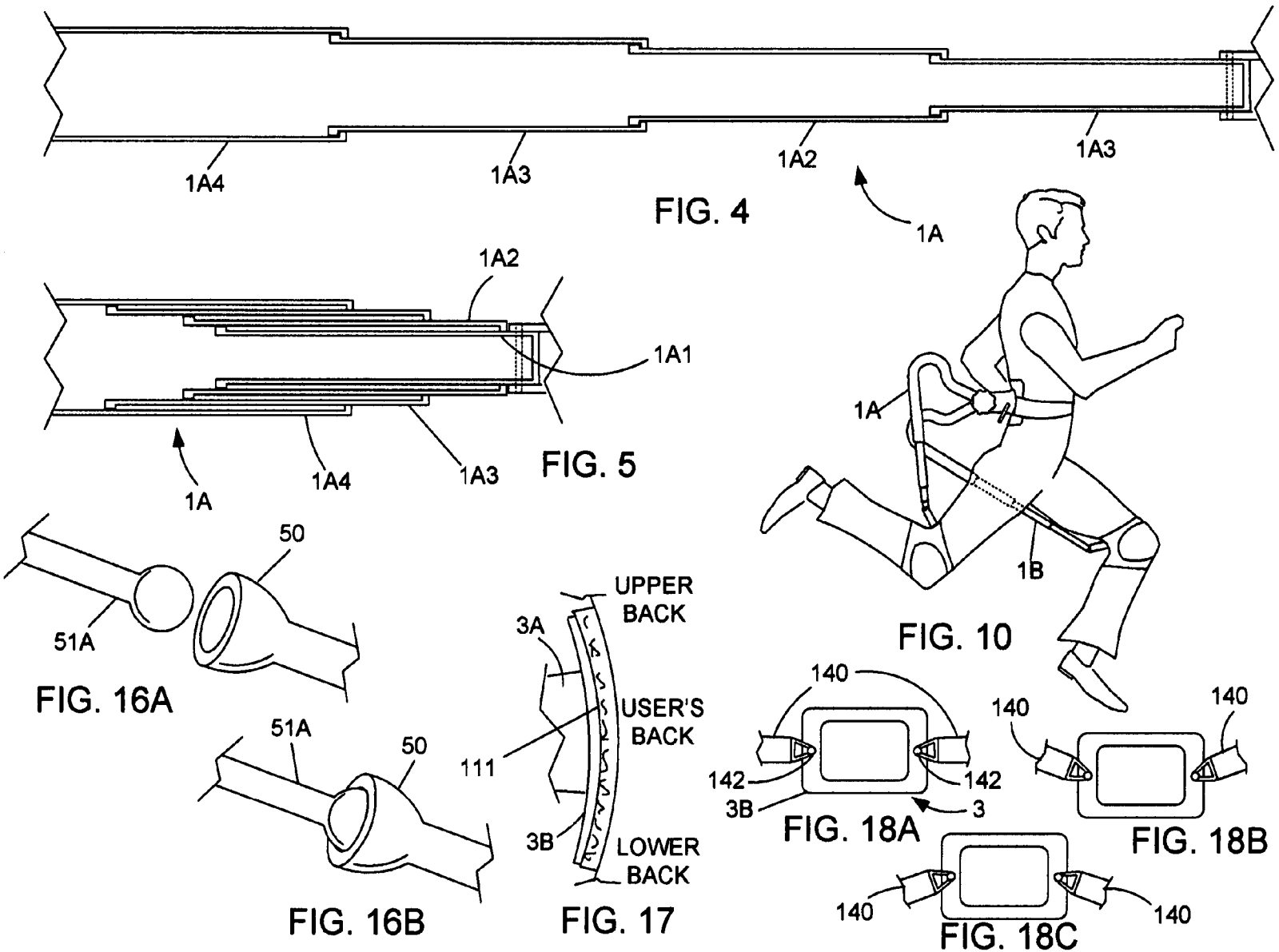
FIGS. 4-5 show a preferred torque arm.
FIG. 10 shows the utilization of a preferred embodiment of the present inventions
FIGS. 16A-16B shows a preferred method of joining a torque arms to a leg mount.
FIG. 17 shows a preferred shaft housing unit with cushioning.
FIGS. 18A-18C show a preferred swivel belt.

FIGS. 4 and 5 show a simple side view of a portion of torque arm 1A. In the preferred embodiment, telescopic section 1A1 slides easily inside telescopic section 1A2. Telescopic section 1A2 slides easily inside telescopic section 1A2. Telescopic section 1A3 slides easily inside main torque arm section 1A4.

In FIG. 4 torque arm 1A is extended so that the overall length of torque arm has been increased. Telescopic sections 1A1, 1A2 and 1A3 each have slid rightward to their rightmost position.

In FIG. 5 torque arm 1A has been compressed so that the overall length of torque arm 1A has been decreased. Section 1A1 has slid to the left inside section 1A2. Section 1A2 has slid to the left inside section 1A3. Section 1A3 has slid to the left inside main torque arm section 1A4.

It should be noted that because torque arms 1A and 1B are telescopic that they will lengthen and shorten according to the movement of the user allowing full range of motion. Also, telescopic torque arms 1A and 1B will adjust automatically to the user's height.

Body-Mounted Shaft Housing Unit

FIGS. 1A, 1B and 1C show a preferred tension-adjustable body-mounted shaft housing unit 3. Shaft housing unit 3 includes casing 3A and back support piece 3B. FIG. 1D shows a side view of casing 3A. In a preferred embodiment, a hole is drilled through the side of shaft housing 3. Spacer tube 10 is then welded into the hole. Shaft 4 is then extended through spacer tube 10.

Preferably, shaft housing unit 3 is sewn into adjustable belt 45 (FIG. 1A). Also, preferably, back support piece includes cushion pad 111 (FIG. 17). Back support piece 3B provides support for the user's upper and lower back.

Preferably, knob 5B is locked to shaft 4 via a pin (FIG. 1C). Thrust bearing 1B is adjacent knob 5B. A plurality of Belleville disc springs are arranged in series adjacent thrust bearing 11B to form Belleville disc spring column 12B. Washer 13B is adjacent Belleville disc spring column 12B. Torque arm 1B is adjacent washer 13B. Washer 15B is between torque arm 1B and spacer tube 10.

On the opposite side of spacer tube 10, Washer 15A is between torque arm 1A and spacer tube 10. Washer 13A is between torque arm 1A and Belleville disc spring column 12A. Thrust bearing 11A is between knob 5A and Belleville disc spring column 12A. Knob 5A is threaded onto shaft 4. Load indicator device 16 is locked to shaft 4 via pin 17 (FIG. 8) adjacent knob 5A.

Leg Mounts

Leg mounts 35A and 35B are preferably sewn into knee mounts 2A and 2B, respectively (FIG. 1A). As shown in FIG. 1B, leg mounts 35A and 35B are preferably pivotally connected to torque arms 1A and 1B. Also as shown in FIG. 1B, leg mounts 35A and 35B include hard surface sections 35C and 35D, respectively. Hard surface sections 35C and 35D act as a hard surface to stabilize torque arms 1A and 1B and to prevent connector sections 35E and 35F from digging into the user's legs.

Knee Mounts

Knee mounts 2A and 2B (FIG. 1A) each include two straps. One of the straps wraps around the knee below the knee cap and the other strap wraps around above the knee cap. The straps function to prevent knee mounts 2A and 2B and torque arms 1A and 1B from moving or sliding up or down the legs from moving or sliding sideways.

Load Indicator Device

FIGS. 6-9 show the operation of load indicator device 16.

Figure 8:
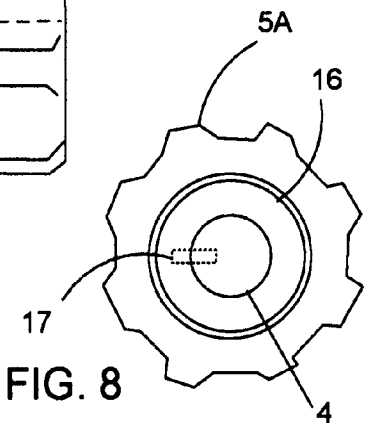
FIGS. 8-9 shows a preferred knob and load indicating device.
Figure 9:
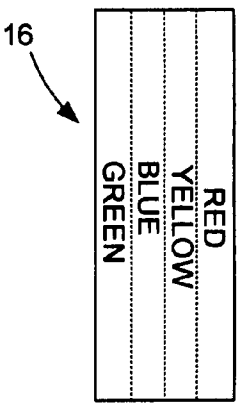

FIG. 8 shows load indicator device 16 pinned to shaft 4 via pin 17. Knob 5A is threaded onto shaft 4 and has a cutout section to accommodate load indicator device 16. FIG. 9 shows a detailed side view of load indicator device 16. Preferably, load indicator device 16 is color-coded to indicate the amount of compressive force exerted onto torque arms 1A and 1B as knob 5A is adjusted. In a preferred embodiment, "GREEN" indicates light compressive force, "BLUE" indicates medium compressive force, "YELLOW" indicates high compressive force, and "RED" indicates very high compressive force. The greater the compressive force exerted onto torque arms 1A and 1B, the more difficult it is for the user to generate enough torque to overcome the compressive force and to move his legs forward and backward in a walking or running motion.

Figure 6:
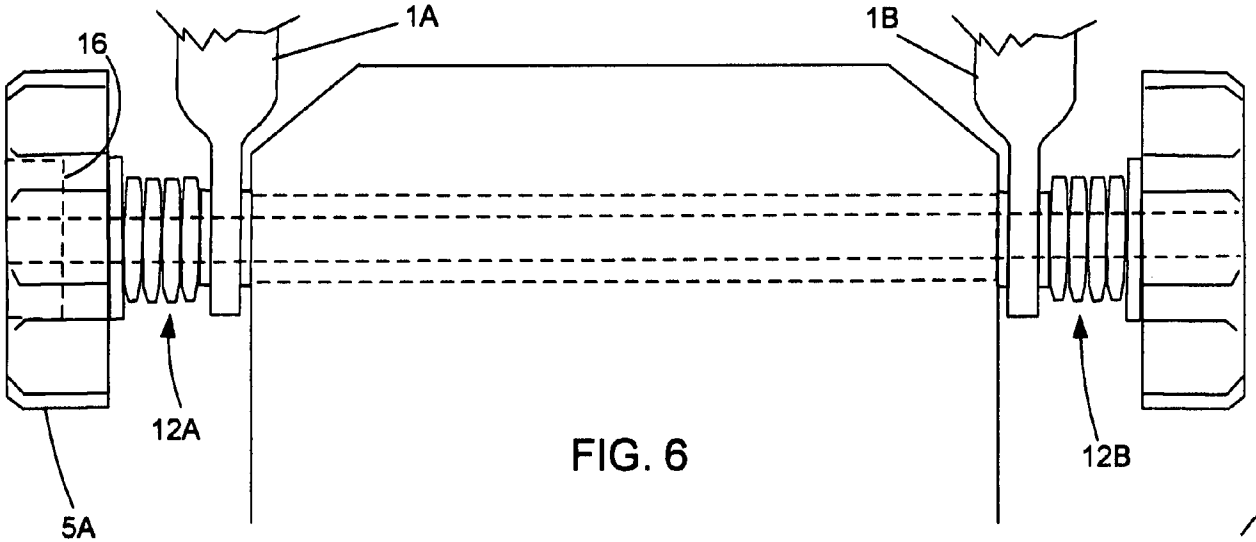
FIGS. 6-7 show how torque is preferably adjusted.

In FIG. 6, knob 5A has been turned counterclockwise so that load indicator 16 is covered by knob 5A. This indicates to the user that knob 5A is positioned so that there is essentially no compressive force being exerted onto torque arms 1A and 1B. It is therefore very easy for the user to move his legs.

Figure 7:
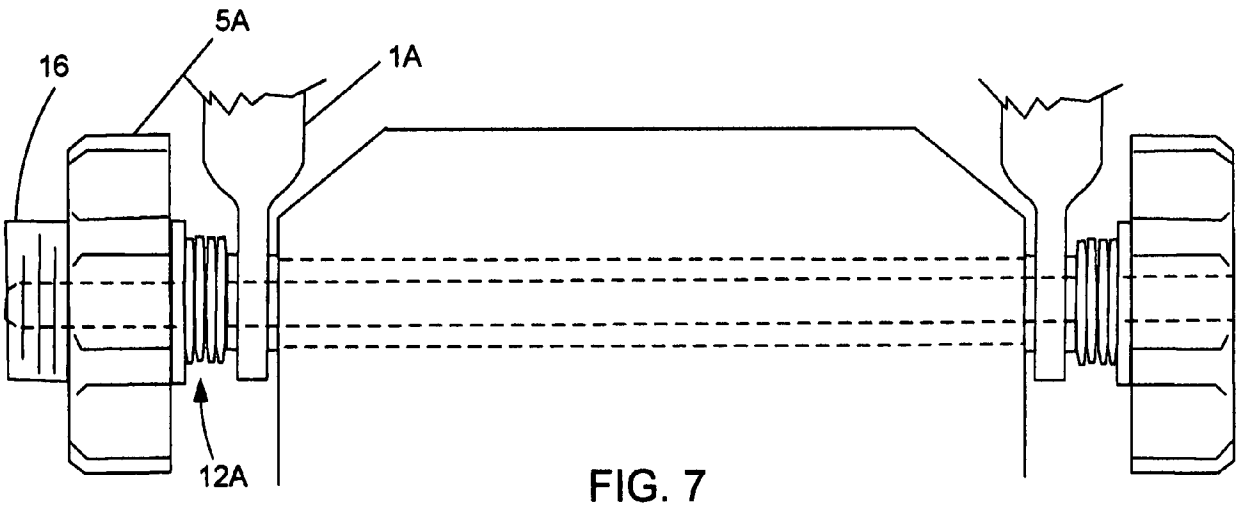

In FIG. 7, the user has turned knob 5A clockwise so that load indicating device 16 shows "RED" (FIG. 9). Belleville disc spring columns 12A and 12B have been compressed and very high compressive forces are being exerted on torque arms 1A and 1B. It will therefore challenge the user's ability to a higher level.

Utilization of the First Preferred Embodiment

FIGS. 2A-2D describe a sequence of events showing the utilization of a first preferred embodiment of the present invention.

In FIGS. 2A-2D the user is exercising while walking. The user is also gaining additional exercise by pulling handles 6A and 6B to stretch cords 7A and 7B.

Prior to beginning his exercise, the user has tightened knob 5A so that medium compressive forces are being exerted on torque arms 1A and 1B (see above discussion). Therefore, the user will have to generate an increased amount of torque to pivot torque arms 1A and 1B clockwise and counterclockwise around shaft 4.

Figure 2D:
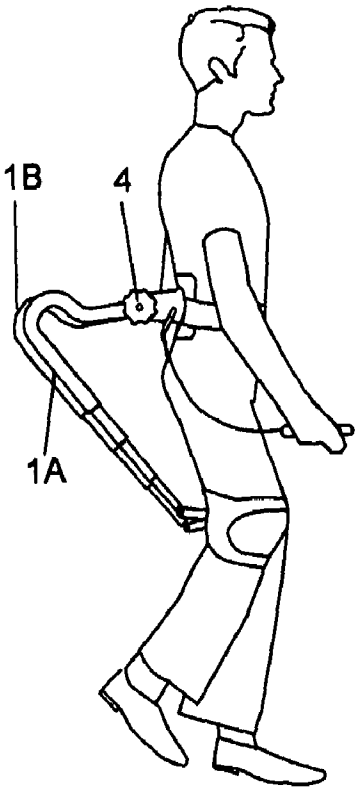
FIGS. 2A-2D show the utilization of a preferred embodiment of the present invention.
Figure 2C:
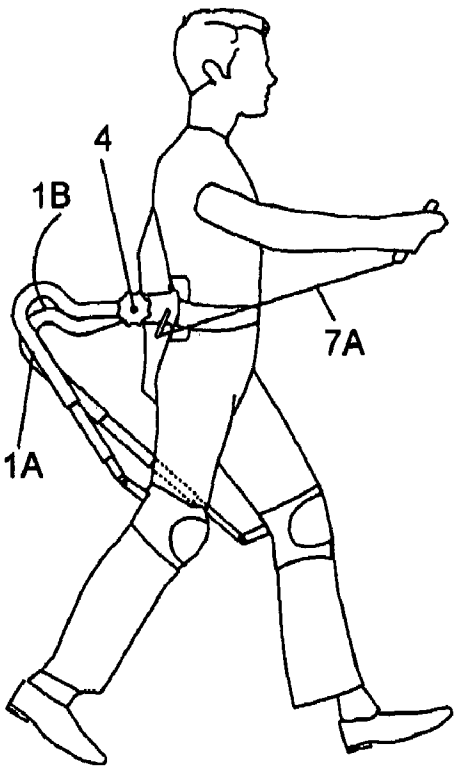
Figure 2B:
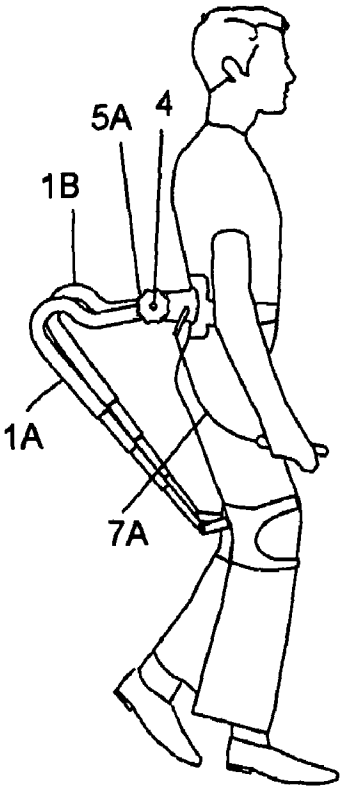
Figure 2A:
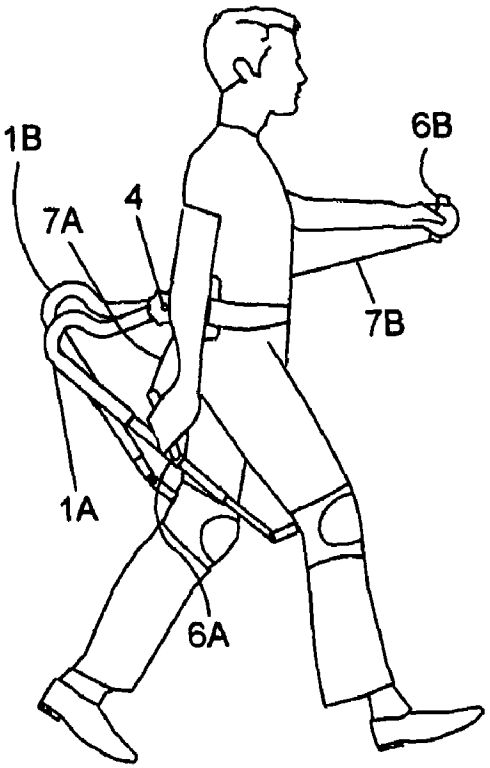

In FIG. 2A, the user has stepped forward with his right foot. This has caused torque arm 1A to pivot counterclockwise about shaft 4. The momentum of the user stepping forward with his right foot has caused the user's upper body to move forward in relation to his left foot. This motion has caused torque arm 1B to pivot clockwise about shaft 4. Also, in FIG. 2A the user has raised his left hand and has pulled cord 7B tight.

In FIG. 2B the user has planted his right foot on the ground and has begun to step forward with his left foot. The user's upper body is positioned approximately over the user's right foot. Torque arm 1A has pivoted clockwise about shaft 4 and torque arm 1B has pivoted counterclockwise about shaft 4. The user has lowered his left arm.

In FIG. 2C, the user has stepped forward with his left foot. This has caused torque arm 1B to pivot further counterclockwise about shaft 4. The momentum of the user stepping forward with his right foot has caused the user's upper body to move forward in relation to his left foot. This motion has caused torque arm 1A to pivot further clockwise about shaft 4. Also, in FIG. 2C the user has raised his right hand and has pulled cord 7A tight.

In FIG. 2D the user has planted his left foot on the ground and has begun to step forward with his right foot. The user's upper body is positioned approximately over the user's left foot. Torque arm 1B has pivoted clockwise about shaft 4 and torque arm 1A has pivoted counterclockwise about shaft 4. The user has lowered his right arm.

In this fashion the sequence shown in FIGS. 2A-2D is repeated. As explained above the user can tighten knob 5A to increase the resistance or loosen knob 5A to decrease the resistance.

Running

FIGS. 2A-2D describe just one manner in which the present invention may be used. It can also be used in a variety of other manners. For example, FIG. 10 shows a user running while utilizing the present invention. Because he is running the user's stride is greater than it is while he is walking (FIGS. 2A-2D). Therefore, the amount torque arms 1A and 1B have pivoted is also greater. The difference can be seen by comparing the positions of torque arms 1A and 1B in FIG. 10 to their positions in FIGS. 2A and 2C.

Preferred Handle Rods

Figure 11:
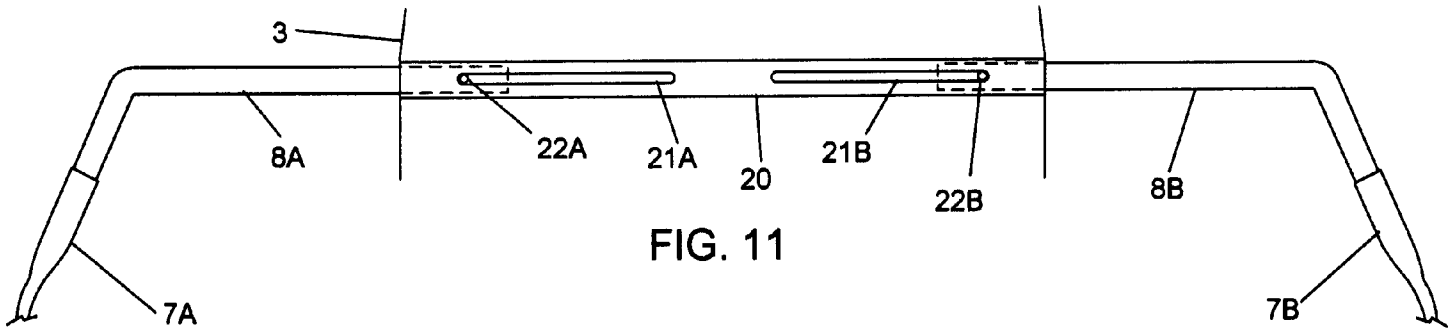
FIGS. 11-12 show preferred handle rods.
Figure 12:
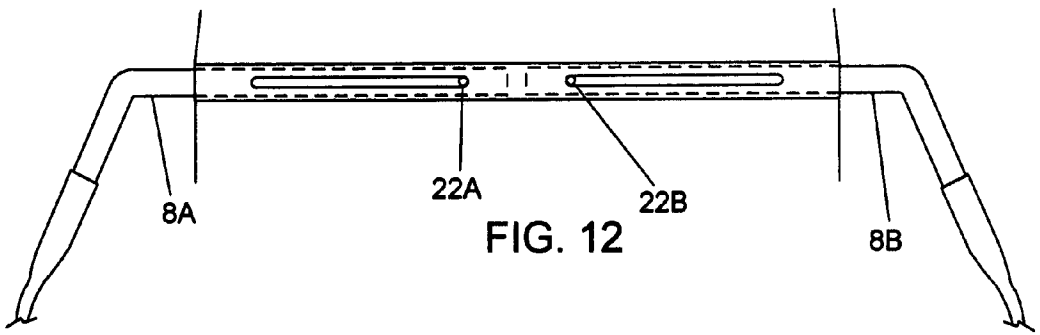

A top view of preferred handle rods 8A and 8B is shown in FIGS. 11 and 12. In a preferred embodiment, a hole is drilled into the side of shaft housing unit 3 to accommodate hollow support tube 20 (FIG. 1D). Support tube 20 is then welded to shaft housing unit 3. Support tube 20 preferably includes slots 21A and 21B for receiving spring loaded pins 22A and 22B of handle rods 8A and 8B, respectively. Rods 8A and 8B slide horizontally in and out of shaft housing unit 3 and automatically adjust according to the user's shoulder width.

In FIG. 11 the user has slid handle rod 8A to its leftmost position and has slid handle rod 8B to its rightmost position. Spring loaded pins 22A and 22B prevent the user from sliding rods 8A and 8B completely out of support tube 20. The positions of rods 8A and 8B shown in FIG. 11 are preferable for a user with extremely broad shoulders.

In FIG. 12 the user has slid handle rod 8A to its rightmost position and has slid handle rod 8B to its leftmost position. Spring loaded pins 22A and 22B prevent the user from sliding rods 8A and 8B so far that they collide with each other. The positions of rods 8A and 8B shown in FIG. 12 are preferable for a user with extremely narrow shoulders.

For a user with shoulders of medium width, the user can slide rods 8A and 8B so that they are positioned approximately halfway between the positions shown in FIGS. 11 and 12.

Preferred Knob

Figure 13:
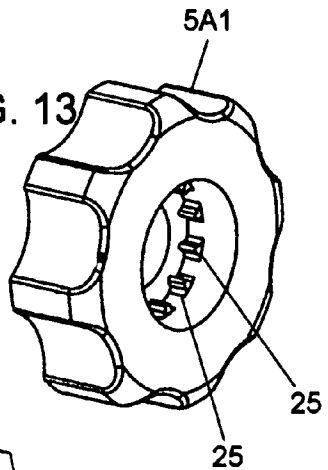
FIG. 13 shows a preferred knob.

The above discussion described in detail how knob 5A is adjusted to vary the compressive force applied to torque arms 1A and 1B. FIG. 13 shows another preferred knob 5A1. Knob 5A1 clicks as it is turned clockwise or counterclockwise by the user. The user can use the clicks to help precisely adjust the compressive force on torque arms 1A and 1B. For example, on Tuesday the user may have exercised for 30 minutes with knob 5A1 turned clockwise 9 clicks. On Thursday, the user wants to slightly increase the resistance. Therefore, he will turn knob 5A1 clockwise 10 clicks.

FIG. 13 shows a perspective view of knob 5A1. Knob 5A1 includes multiple wedges 25.

Figure 14C:
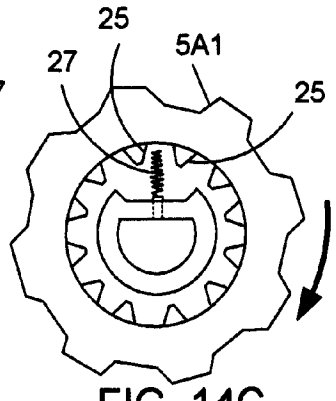
FIGS. 14A-14C show a preferred load indicating device.
Figure 14B:
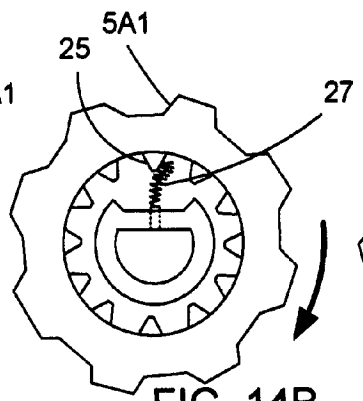
Figure 14A:
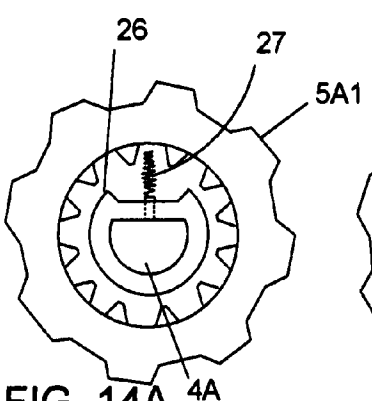

FIG. 14A shows a side view of knob 5A1 threaded onto D-shaft 4A. Washer 26 is slid onto D-shaft 4 adjacent to knob 5A1. D-shaft 4A includes spring 27.

In FIG. 14B the user has begun to turn knob 5A1 slightly clockwise. A wedge 25 has come into contact with spring 27.

In FIG. 14C the user has turned knob 5A1 more so that spring 27 snaps back and collides into an adjacent wedge 25. The snapping back and collision with the adjacent wedge creates an audible click that the user can rely upon to gage how much he has turned knob 5A1.

Figure 15:
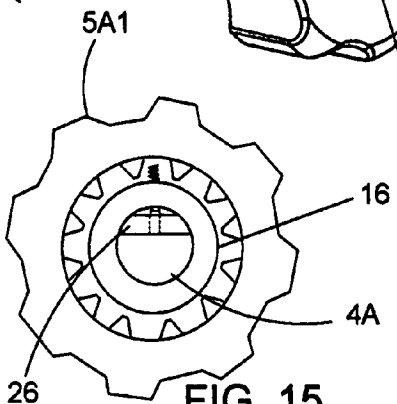
FIG. 15 shows a preferred load indicating device.

In FIG. 15C load indicating device 16 has been threaded onto D-shaft 4A. By utilizing the device shown in FIG. 15C the user can both visually gage how far he has turned knob 5A1 by looking at load indicating device 16 (FIG. 9) and he also audibly gage how far he has turned knob 5A1 by listening to clicks (FIGS. 14A-14C).

Bent Torque Arms

Figure 3B:
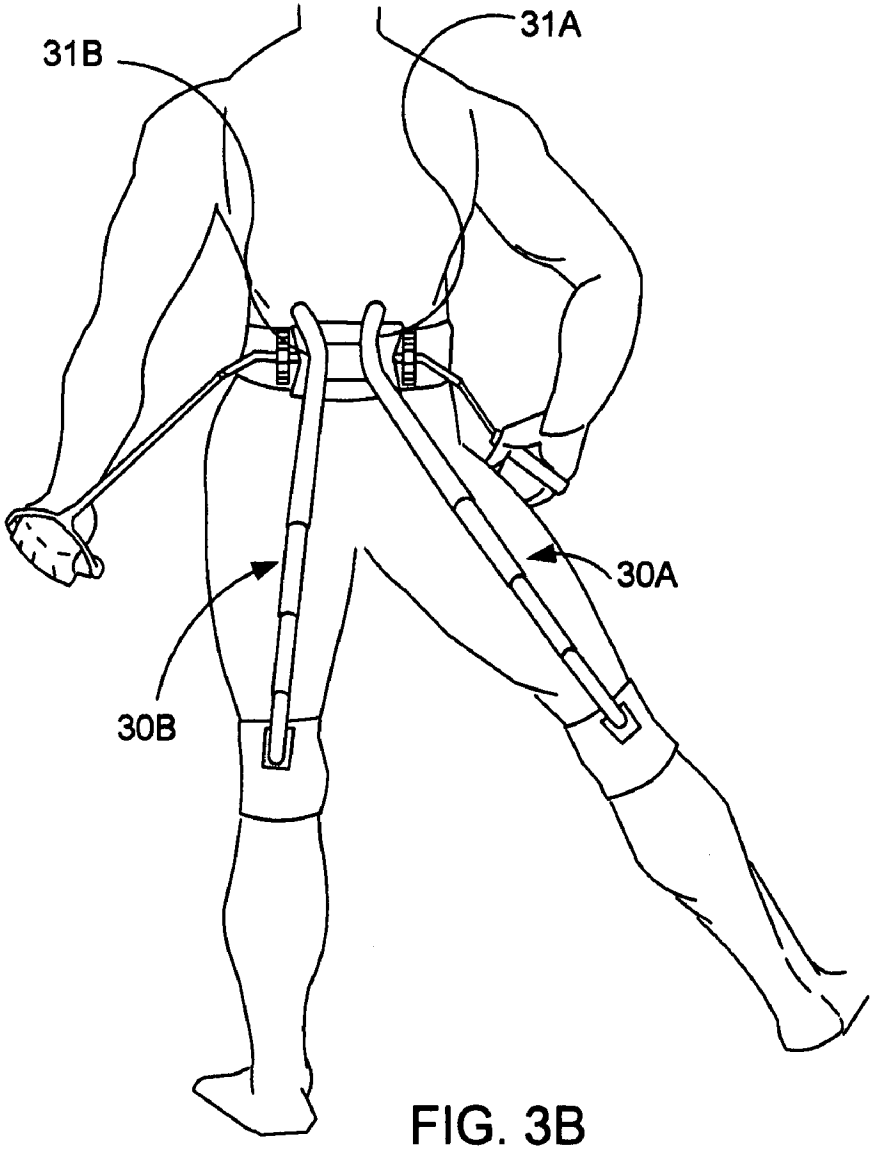
FIGS. 3A-3B show another preferred embodiment of the present invention.
Figure 3A:
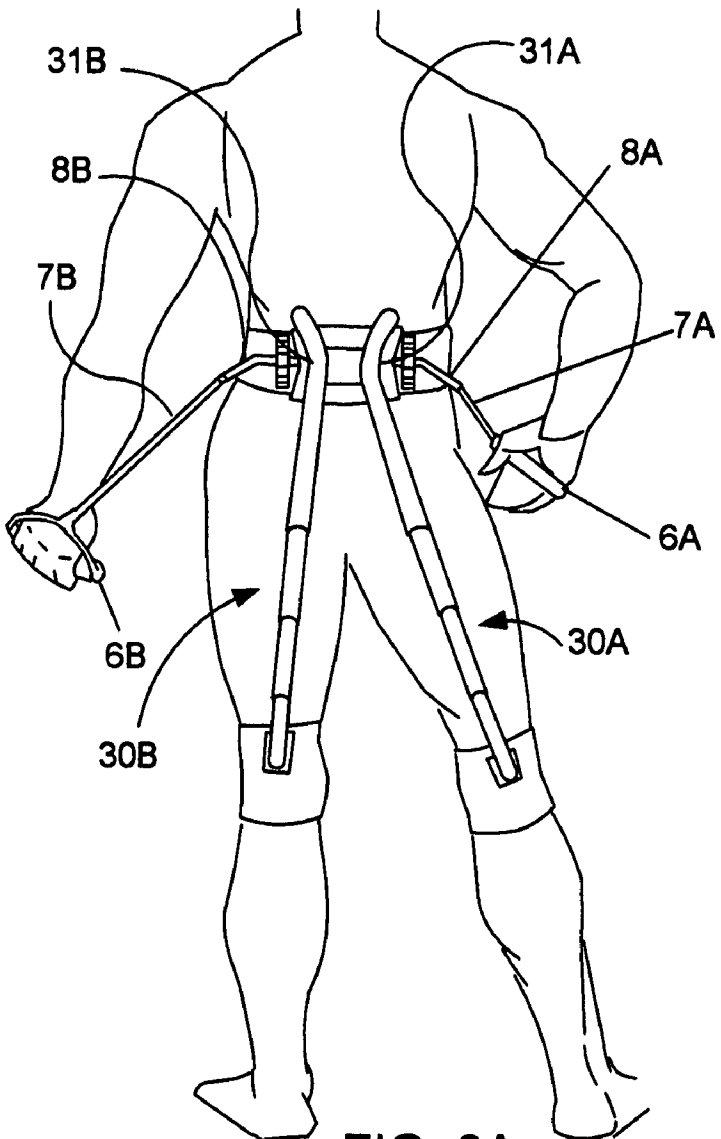

In the preferred embodiment shown in FIGS. 3A and 3B, torque arms 30A and 30B are bent at upper sections 31A and 31B, respectively. By utilizing bent torque arms, the user is able to achieve greater lateral movement with his legs. For example, in FIG. 3B the user has raised his right leg.

Because there is a bend at upper sections 31A and 31B, the user can raise his leg laterally and torque arms 30A and 30B will not bump into each other.

Benefits of the Invention

The present invention provides numerous benefits. Some of these are listed below. For example, users of the invention will experience an increased oxygen consumption rate while utilizing the invention. The greater the amount of oxygen consumed during a cardio workout, the shorter the required duration of the workout. Also, the present invention will improve the user's cardio system, his muscle strength and his flexibility. The user will become more limber due to the large range of motion achievable. The adjustable knob will allow the user to control and vary the resistance workload. The present invention is easy to use, portable, lightweight, easy to store and affordable. A tall person, a short person, an overweight person or a slim person can all use and gain benefits from the present invention. The waist mount will support the upper and lower back. The adjustable belt will fit any waist size. The knee mounts will support the knees and provides an additional level of support.

The present invention creates a fitness device which will stimulate the muscles while the user is engaged in an aerobic activity such as walking, running or jogging. The user can exercise indoors or outdoors. Also, the user can exercise a large number of muscle groups with a very low equipment expense and without wasting unnecessary time.

Swivel Belt

FIGS. 18A-18C show another preferred embodiment that utilizes swivel belt 140. Swivel belt 140 is pivotally connected to buttons 142. Buttons 142 are both rigidly connected to back support piece 3*b* of shaft housing unit 3. Swivel belt 140 can pivot up or down depending on the wishes of the user. For example, if the user has a large stomach, he may want swivel belt 140 to pivot downwards as shown in FIG. 18C. Conversely, if he has an injury, he may want swivel belt 140 to pivot upwards as shown in FIG. 18B.

Although the above-preferred embodiments have been described with specificity, persons skilled in this art will recognize that many changes to the specific embodiments disclosed above could be made without departing from the spirit of the invention. For example, it was described above how torque arms 1A and 1B are preferably pivotally connected to leg mounts 35A and 35B. It should be recognized that there are a variety of ways in which to connect the torque arms to the leg mounts. For example, FIGS. 16A and 16B show that torque arms 51A can be connected to leg mounts 50 via a ball and socket joint. This manner of connection allows for greater mobility of the legs in various directions. Also, even though the above preferred embodiments described how Belleville springs were utilized to vary the compression on torque arms 1A and 1B, it should be understood that a variety of springs could be used in stead of Belleville springs. For example, a coil spring could be utilized as well. Also, although the above description given in FIGS. 2A-2D show the user pulling on handles 6A and 6B, it is possible to utilize the present invention without attaching handles. For example, FIG. 10 shows a user running without holding handles. Therefore, the attached claims and their legal equivalents should determine the scope of the invention.

What is claimed is:

1. A personal exercise device, comprising:

A) a body mounted shaft housing for mounting a shaft at a position near the rear portion of a user's waist, wherein said body mounted shaft housing is mounted to a user's body via a belt B) a shaft confined within said shaft housing, C) two leg mounts attached to each of two legs of the user near said user's knees, D) two torque arms each having two ends, said two torque arms attached pivotally at one end to one of said leg mounts and attached pivotally at the other end to said shaft, and E) at least one torque resistance mechanism comprising at least one torque adjustment device for adjusting torque required to produce pivot motion of said torque arms about said shaft.

2. The personal exercise device as in claim 1, wherein each of said two torque arms comprises at least one telescopic section.

3. The personal exercise device as in claim 1, wherein each of said torque arms comprises a bent upper section so that greater lateral movement of legs can be achieved.

4. The personal exercise device as in claim 1, wherein said two torque arms are connected via a ball-and-socket joint to said two leg mounts.

5. The personal exercise device as in claim 1, further comprising two knee mounts, wherein said two leg mounts are attached to said two knee mounts.

6. The personal exercise device as in claim 5, wherein said two leg mounts are sewn into said two knee mounts.

7. The personal exercise device as in claim 1, wherein said belt is adjustable to the size of the user's waist.

8. The personal exercise device as in claim 7 wherein said body mounted shaft housing is sewn into said belt.

9. The personal exercise device as in claim 1, wherein said torque resistance mechanism further comprises at least one spring attached to said shaft, wherein said at least one spring is compressed when said torque adjustment device is tightened and wherein said at least one spring expands when said at least one torque adjustment device is loosened.

10. The personal exercise device as in claim 9, wherein said at least one spring is at least one Belleville spring.

11. The personal exercise device as in claim 1, wherein said at least one torque adjustment device is a knob threaded onto said shaft.

12. The personal exercise device as in claim 1, further comprising at least one load indicating device.

13. The personal exercise device as in claim 12, wherein said at least one load indicating device is a color-coded device attached to said shaft.

14. The personal exercise device as in claim 12, wherein said at least one load indicating device emits a clicking sound when said at least one torque adjustment device is utilized to adjust the amount of torque.

15. The personal exercise device as in claim 1, further comprising at least one handle connected to said body mounted shaft housing via a flexible cord, wherein said at least one handle is pulled to stretch said flexible cord for upper body strength training.

16. The personal exercise device as in claim 15 further comprising at least one handle rod wherein said flexible cord is connected to said shaft housing at said at least one handle rod, wherein said at least one handle rod automatically adjusts to the user's shoulder size.

17. The personal exercise device as in claim 5, wherein each of said two knee mounts comprises:

A) an upper strap, and

B) a lower strap, wherein said upper and lower straps function to prevent up-and-down and side-to-side sliding of each of said two knee mounts.

18. The personal exercise device as in claim 1, wherein said torque arms are telescopic torque arms, wherein said telescopic torque arms automatically adjusts to the height of the user.

19. The personal exercise device as in claim 1, wherein said body mounted shaft housing is mounted to a user's body via a swivel belt, wherein said swivel belt is capable of pivoting upwards or downwards.

* * * * *